United States Patent [19]

Hamilton

[11] Patent Number: 4,662,149

[45] Date of Patent: May 5, 1987

[54] TABLE-TOP APPARATUS AND METHOD FOR FORMING SEALING PACKAGES

[76] Inventor: Joel A. Hamilton, 101 Hardenburgh Ave., Demarest, N.J. 07627

[21] Appl. No.: 845,451

[22] Filed: Mar. 28, 1986

[51] Int. Cl.[4] ..... B65B 11/52; B65B 59/00

[52] U.S. Cl. ..... 53/453; 53/51; 53/559

[58] Field of Search ..... 53/453, 454, 559, 560, 53/51

[56] References Cited

U.S. PATENT DOCUMENTS

| | | | |
|---|---|---|---|
| 2,879,635 | 3/1959 | Brock | 53/453 X |
| 3,267,639 | 8/1966 | Ollier et al. | 53/51 |
| 3,475,878 | 11/1969 | West, Jr. | 53/51 X |
| 3,767,349 | 10/1973 | Jezuit | 53/559 X |
| 3,874,143 | 4/1975 | Braber | 53/453 X |
| 3,996,726 | 12/1976 | Schlachter | 53/51 X |
| 4,490,963 | 1/1985 | Knudsen | 53/559 |
| 4,548,018 | 10/1985 | Wojnicki | 53/51 |
| 4,549,386 | 10/1985 | Wilson | 53/51 |

*Primary Examiner*—James F. Coan
*Attorney, Agent, or Firm*—Ralph R. Roberts

[57] ABSTRACT

This invention provides apparatus and a method for forming, filling, sealing and cutoff of a package in which a thermoform film rigid bottom member is formed in a forming station adjustably positioned on a base. A loading station and a sealing station like the forming station, also adjustably positioned, are also provided. Both the forming and sealing stations have an adjusting guide means in which the roll supply is carried on a tubular support and the guides are carried on a hingedly secured threaded rod. The lower film and sealing cover as a strip are advanced by edge clamp means, with a first pair of clamps adjustably positioned and carried by a support and a second pair of clamps adjustably positioned on a support reciprocably moved along slide rails by a rotary actuator with an actuated drag link and crank arm. The acceleration and deceleration are produced by the drag link and alternate clamping and unclamping of the strip by valve means.

25 Claims, 10 Drawing Figures

TABLE-TOP APPARATUS AND METHOD FOR FORMING SEALING PACKAGES

BACKGROUND OF THE INVENTION

1. Field of the Invention

With respect to the classification of art as established in and by the U.S. Patent Office, this invention is believed to be found in the general class of package making and, in particular, to apparatus and a method for forming a cavity in a thermoformed plastic strip, filling said cavity, and then sealing this filled cavity by another film which is sealed to the filled carrier and then severing this filled and sealed package.

2. Description of the Prior Art

Form-seal-and -wrap apparatus is well known and many U.S. patents showing apparatus and methods and also not the subject of patents are known in the industry. A pre-ex search in the art was made, but certain portions of this apparatus and method are believed to be novel. Among the patents found in this search were U.S. Pat. No. 2,879,635 to BROCK, as issued Mar. 31, 1959, which is one of the basic apparatus for forming, filling and sealing products. This apparatus contemplates a carrier band having spaced apertures. This apparatus does not contemplate adjustability and does not have the desired flexibility and versatility provided by Applicant's invention. U.S. Pat. No. 3,045,403 to MITCHELL, as issued July 24, 1962, provides web advancing mechanism and gripping means for positive advancement, but essentially this apparatus is for articles of clothing in web stock which is quite flexible.

U.S. Pat. No. 3,267,639 to OLLIER et al, as issued Aug. 23, 1966, shows a form, fill and seal apparatus similar to the BROCK apparatus but without a belt conveyor. Advance of the upper and lower films is by a reciprocated member. Clamping and release is by a jack pneumatically actuated. This clamping advances both films after package sealing is achieved. Also noted was U.S. Pat. No. 3,577,700 to BIPPUS, as issued May 4, 1971, which is similar to other apparatus, but uses a punching action to determine a desired spacing of the cutting action. This patent shows a deep draw of a lower thermoformed sheet which is cut into short members before forming. This transport is by a conveyor, but punching and cutting employ a procedure that does not provide the apparatus in the present invention.

U.S. Pat. No. 3,767,349 to JEZUIT, as issued Oct. 23, 1973, is a packaging machine wherein films are fed from supply rolls as in prior devices. This patent is noted in that adjustable guide means is provided for accommodation of different widths of film. U.S. Pat. No. 4,008,554 to HARDY, as issued Feb. 22, 1977, shows a meat product sealed between two films. Forming as provided is shown in both upper and lower films. U.S. Pat. No. 4,068,448 to MODEEN, as issued Jan. 17, 1978, employs opposed rollers having relieved central portions and a power means with a one-way clutch drive. U.S. Pat. No. 4,490,963 to KNUDSEN, as issued Jan. 1, 1985, is another form, fill and sealing apparatus where reliability of a precise cutting of the resulting package strip is provided by a timing cam shaft.

Also noted was U.S. Pat. No. 4,548,018 to WOJNICKI, as issued on Oct. 22, 1985, which shows apparatus for forming, filling and sealing film pouch material. It is to be noted that the cover material is delivered on a separate delivery means and then is transferred to the sealing station. This is to prevent weight discrepancy.

U.S. Pat. No. 4,549,386 to WILSON, as issued Oct. 29, 1985, shows another version of a form, fill and seal apparatus. It is to be noted that the sealing jaws are adapted to seal a package as a film overwrap.

It is to be noted that apparatus in this field is well shown in the list of cited reference patents in No. 4,548,018 noted above and in many variations thereof. In the above-noted patents and in other patents and apparatus presently available commercially, the apparatus is required to package a succession of articles or items which are nominally of like size. Often such apparatus provide means for changes in product size and usually for a run in which the product is of the same size. The change in size requires a change in settings and often apparatus components. Changing settings usually involves considerable effort on the attendant's behalf to accommodate these required changes. In the apparatus described hereinafter, the apparatus provides a simple adjustment which makes for the desired size change for those items which are to be wrapped and sealed. The hereafter-described apparatus does not contemplate speed changes and/or drives, although changes in drive mechanism are often required in other known apparatus. These changes are unlikely to be achieved by a simple and easily achieved adjustment as is provided in the described apparatus of this invention.

To establish synchronism of the several elements used in known apparatus, differential gearing, timing belt and pulleys and the like are provided and require extended time periods with procedures to insure fine adjustment of synchronism during routine operation of the machine apparatus. Differential gearing when and where used is complex, requiring a multiplicity of parts which are expensive to manufacture. Changing the apparatus to accommodate another product size has hitherto been an operation performed by a technician or engineer. The present invention provides a simplification of adjustment so that changing the wrapping procedure is easily performed and it is feasible for such changes to be made by the attendant of the machine apparatus.

In many of the previously known and supplied horizontal form-fill-seal wrapping apparatus, rotary forming and sealing dies or jaws are employed, particularly for transverse sealing of the wrapper web between successively wrapped product items. A seal of adverse quality results where or when rotary sealing jaw speed is markedly different from the wrapper speed. Rotating sealing jaws which are caused to rotate in synchronism move at substantially the speed of advance of the wrapping web. A speed change for a change in the wrapping of a product changes the period of time. The present invention provides forming and sealing dies in which changes in web speed, packagage forming and sealing do not adversely affect the seal of the product in the wrapping.

The present invention and the apparatus provided are intended to be adjusted by the attendant of the machine. The form-and-sealing stations are easily changed to accommodate the filling of the formed recess in the bottom film. Film advance is simple and positive and does not provide sudden starts and stops. The length of the advancing stroke is easily changed and provides a means for precise length of package of the wrapped product. The width of the roll supply is easily accommodated and replacement of an empty core with a full spool is also very easily accommodated.

SUMMARY OF THE INVENTION

This invention may be summarized, at least in part, with reference to its objects. It is an object of this invention to provide, and it does provide, a form-fill-and-seal wrapping apparatus in which the bottom plastic strip is fed from a roll to a forming station with intermittent advancement by a mechanism adapted to grasp the web at its edges. After filling, a cover is brought to the filled strip and sealed in place, after which the sealed package as a strip is delivered to cutoff means for severing into determined packages.

It is a further object of this invention to provide, and it does provide, apparatus in which the bottom formed strip of rigid plastic is fed from a roll to a form station, thence horizontally through a filling station, a sealing station, a film-advance station, and thence to a cutoff station. The film-advance station is readily adjustable to precisely advance the sealed package in and with intermittent advancing motions having a smooth starting acceleration and ending deceleration.

It is a further object of this invention to provide, and it does provide, a roll support station in which the core of the roll is sized to rotate on a tubular support and this roll core is easily removed. Adjustable width guide plates are disposed to be brought in way of the sides of the rotating core which is caused to be lifted from guiding position. These adjustable guide plates are carried on a threaded rod which is pivotally supported and retained by a threaded pivoted retainer, with the other end of the threaded rod adapted to be lifted upwardly to lift the guide plates from in way of the core. When providing a guide of the core, these plates are caused to be dropped to a guiding position through a slot or cutout in the tubular support.

In brief, this invention, to be more fully described hereinafter, is designed to be operated by an attendant, with ready adjustment of the apparatus for packaging an article. Both the forming and sealing stations are adjustably positioned along the base support to move closer to or away from a loading station. The forming-and-sealing stations are very similar in that each has a heater member and a forming or sealing die. These portions are carried on the distal ends of pivoted arms and are brought to a closed condition with a hydraulic cylinder that utilizes a toggle action to retain these end members in a closed condition. The upper portion of each station carries a core support in the form of a tubular member in which a slot or cutout is provided in the underside and through this slot protrude guide plates or discs to accommodate the width of the strip of film or cover material.

These strip-retaining discs are carried on a threaded rod having one end pivotally retained in threaded hinged member. These guide discs are adjustably positioned along this threaded rod, with one disc having camming portions adapted to be engaged by a core so as to lift the outer guide from in way of the incoming core. The strip advance is provided with a slide block that is moved in a timed cycle by a rotary actuator. A drag link pivot is pivotally connected to a stroke arm having slot adjustment so that advancement can be precisely made. A terminating switch is provided or an electric eye is used to terminate the strip advance. The packaged product is severed at the end of the advance.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there has been chosen a specific embodiment of a table-top form-fill-and seal apparatus with ready adjustment to accommodate a product to be packaged as adopted for use with rigid thermoplastic support member and showing a peferred means for constructing and assembling said apparatus. This specific embodiment has been chosen for the purposes of illustration and description as shown in the accompanying drawings wherein:

BRIEF DESCRIPTION OF THE DRAWINGS

In the following description and in the claims, various details are identified by specific names for convenience. These names are intended to be generic in their application. Corresponding reference characters refer to like members throughout the several figures of the drawings.

The drawings accompanying, and forming part of, this specification disclose details of construction for the purpose of explanation, but structural details may be modified without departure from the concept and principles of the invention and the invention may be incorporated in other structural forms than shown.

EMBODIMENT OF FIG. 1

Figure 1:
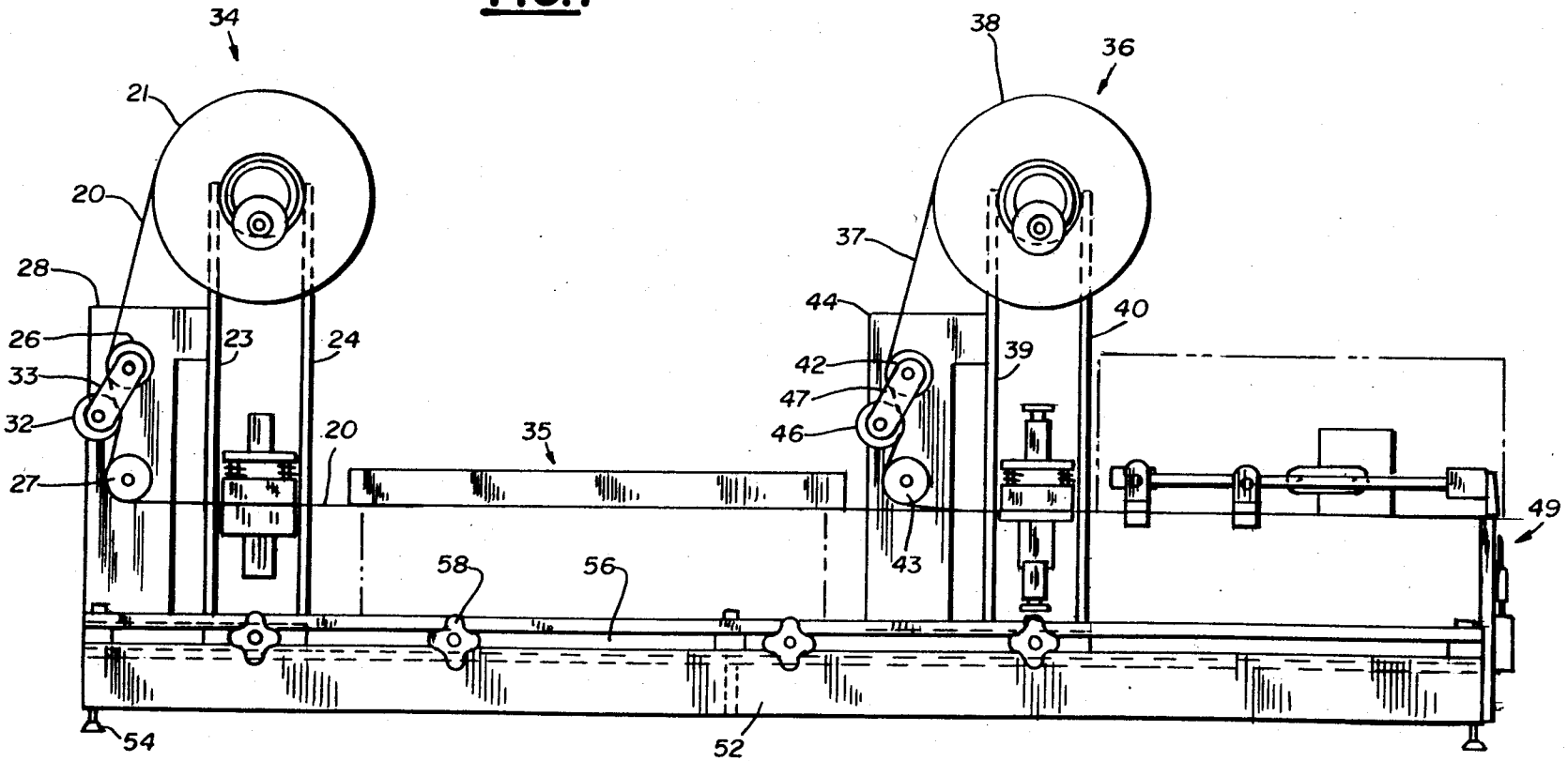
FIG. 1 represents a side view of the apparatus and diagrammatically showing the relationship of the several stations that are provided in this form, fill, seal and sever packaging machine.

Referring next to the drawings, and in particular to FIG. 1, the table-top apparatus is shown in a more or less diagrammatic fashion. As depicted, the films used for the package making include a bottom film 20 that is customarily provided in and as a roll. This film is of a thermoformed type and, although only a few thousandths of an inch in thickness, is substantially a rigid member in contrast to a supple member. This film strip is sufficiently flexible to be drawn from roll 21 carried on near and far support members 23 and 24. This strip is drawn from roll 21 through fixed idler rollers 26 and 27 carried by support means 28. Also carried on this support means is another idler roller 32 carried on a swinging arm 33. These rollers are arrayed so as to provide a small pinch or take-up of the advancing film strip. From the lower roller 27, the film is directed to a substantially horizontal run or extent and is brought in way of forming dies in form station 34 and to be shown and described in conjunction with FIG. 2.

After forming, the lower film 20 is brought to the load area 35 whereat a product is placed in the formed pocket in this lower extent. To the right of this area is a seal station 36 whereat a cover or lid portion is affixed to the lower strip. This seal station is diagrammatically illustrated as substantially identical to the form station in that a top film 37 is carried in a roll 38 on support members 39 and 40. Idler rollers 42 and 43 are like or substantially like idler rollers 26 and 27 described above. These rollers are carried by support means 44 and another swing idler roller, identified as 46, carried on an arm 47 is also carried by this support. This cover film 37 is also directed to the right and is brought into close proximity to film 20. Between the supports 39 and 40 is the sealing station and apparatus 36 to be shown and described in conjunction with FIG. 2.

Figure 7:
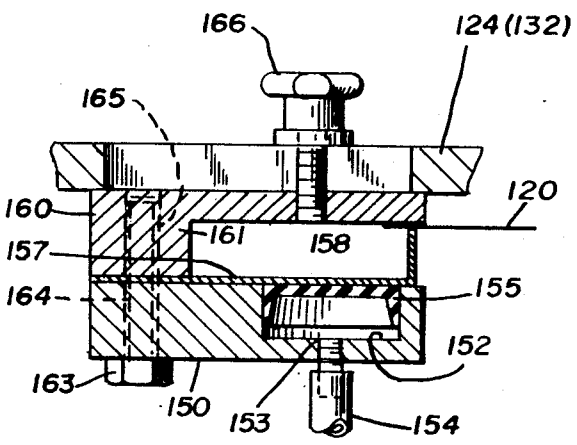
FIG. 7 represents a sectional and side view, quite diagrammatic, and showing the preferred structure of a strip clamp, with four such clamps employed in the film advance mechanism of FIG. 5.
Figure 5:
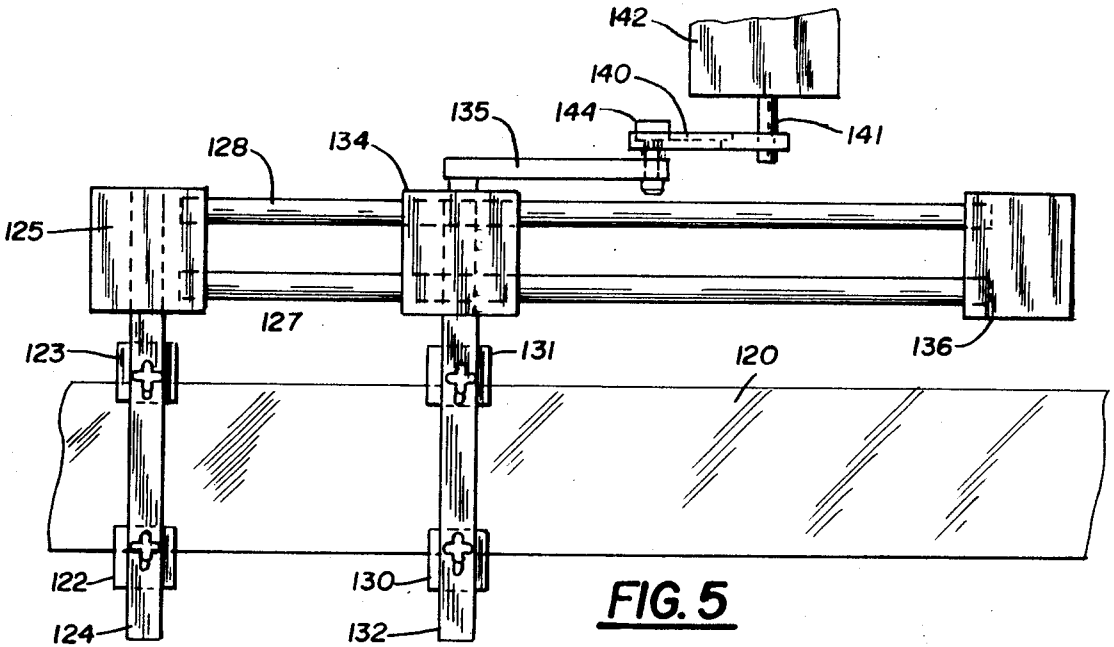
FIG. 5 represents a plan view, very fragmentary and diagrammatic, and showing the structure and action of the components used to advance the strip of packaged product.
Figure 6:
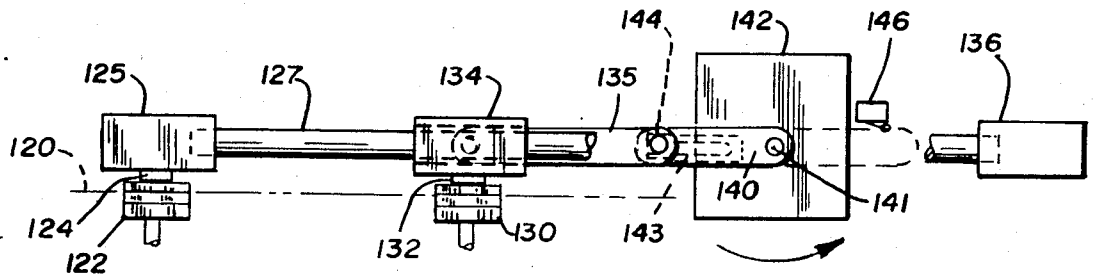
FIG. 6 represents a side view of the apparatus of FIG. 5 and illustrating the relationship and adjusting procedure for lengthening or shortening the stroke used for advancement of the packaged product.

Immediately to the right of the cover sealing station is provided the film advance apparatus as shown in FIGS. 5–7. To the right of this apparatus is diagrammatically depicted a cutoff mechanism 49, which is usually an air-actuated knife device, but no patentable distinction is ascribed thereto as cutoff means is well known and is usually merely a matter of selection.

It is to be noted that this apparatus is carried on a base, generally identified as 52, which is shown as supported and carried by resilient cup members 54. A slot 56 is provided for longitudinal positioning adjustment of either or both stations along the base as a matter of selection, and locking in position is achieved by knob means 58.

EMBODIMENT OF FIG. 2

Figure 2:
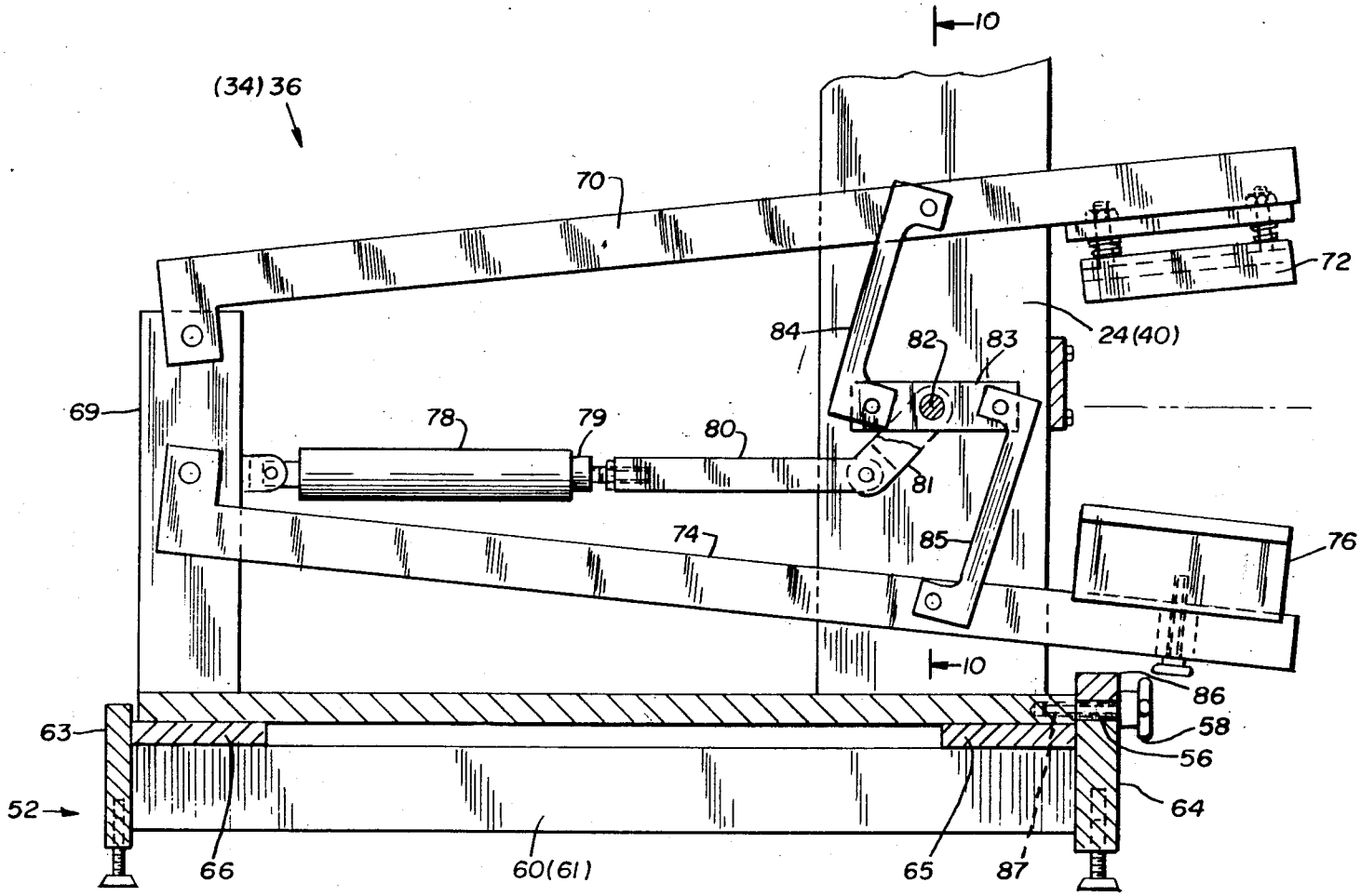
FIG. 2 represents a schematic side transverse view illustrating the components and arrangement of the several members used to provide a form or a seal of the product.

Diagrammatically shown in FIG. 2 is a simple actuation device that is provided for both the form station 34 and the seal station 36 identified above. As depicted in this view, base 52 employs a plurality of transverse members 60 and 61, with member 60 diagrammatically shown. Conventionally, these are at the ends of the frame. Longitudinal rail portions 63 and 64 are provided and extend between and are connected to members 60 and 61. Slide members 65 and 66 are secured to transverse members 60 and 61 and provide support for a plate 68 on which the front or near supports are secured. These forward members are bars or plates with their lower end attached to plate 68 and at their upper ends (not shown) retain a film support to be described more fully in conjunction with FIGS. 3 and 4.

Like shorter support members 69 (shown) are also secured to plate 68. An upper arm 70 is pivotally secured to these shorter support members and is adapted to retain at its distal end a form or seal heater 72. As depicted, this heater is carried by a resilient support such as coil springs. This heater is conventionally an electric heater having a temperature-controlling device. Heater 72 is of a selected configuration and size to accommodate the film being used. Also carried on these shorter support members is a lower arm 74 which is pivotally mounted and carries on its distal end a form or seal die, generally identified as 76. This die, as in the heater die 72, is a matter of selection as to size and configuration so as to suit the package. This die is anticipated to be removably mounted to this arm.

The actuation of the opening and closing of the heater 72 and die 76 is provided by an air cylinder 78, having one end pivotally connected to the shorter support members and with its piston rod 79 having a link arm 80 pivotally connected to a short lever arm identified as 81. This lever arm is rotatable around a pivot post 82 and is fixed to a short lever 83, also rotatable around and supported by pivot post 82. At the outer end portions of lever 83 are pivot connection means to links 84 and 85 which have their other ends pivotally connected to arms 70 and 74.

It is to be noted that slot 56 may be formed in rail 64 or by adding an above bar 86 to provide a determined space between rail 64 and bar 86. Knob 58 is secured to and rotates threaded shank 87 which mates with and is carried in a threaded hole 88 in plate 68. A knob 58 is loosened to permit movement of either the form station 34 or seal station 36, or both, to the desired position. Tightening of the threaded shank 87 causes a lock to be effected between plate 68 and rail 64. The cylinder 78 is fed pressurized air, causing link arm 80 to be moved forwardly. Lever arm 81 is caused to be rotated counterclockwise and the lever 83 is likewise rotated the same angular amount. Links 84 and 85 are swung counterclockwise to cause heater 72 and die 76 to move toward each other to a closed condition. Film 20, when the bottom film is heated, is formed by and in die 76. Conventionally, negative pressure is applied to this heated film, but other forming procedures may be used and are well known, and no patentable distinction is ascribed to this forming procedure. What is to be noted is that in moving lever arm 81 forwardly, links 84 and 85 are moved to a slightly over-center condition so that accidental opening may not occur during an operation. The forward closing movement provided by this cylinder 78 maintains this lock condition until the cylinder is again actuated to produce the open condition of the diagrammatic showing of FIG. 2. The film supply is carried above and on the forward supports 23 or 39, as shown in FIG. 1.

EMBODIMENT OF FIGS. 3 AND 4

Figure 4:
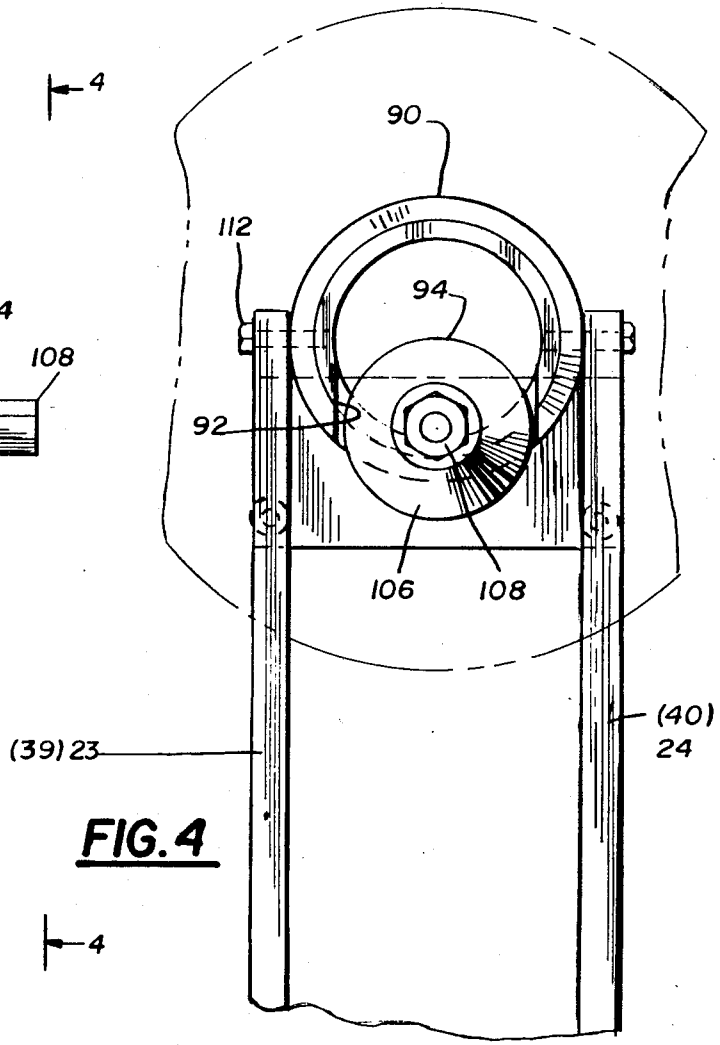
FIG. 4 is an end view of the apparatus of FIG. 3, this view taken on the line 4—4 of FIG. 3 and looking in the direction of the arrows.
Figure 3:
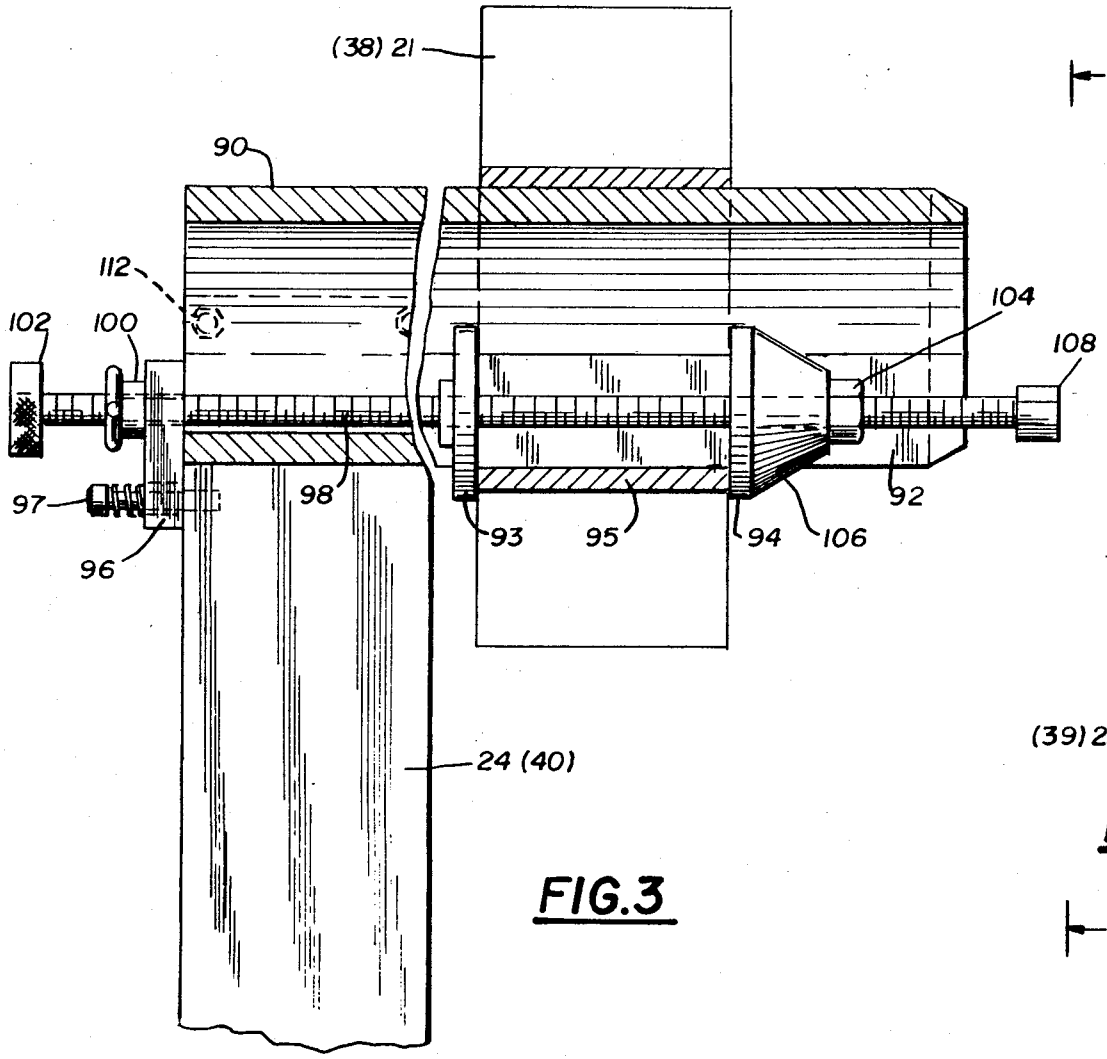
FIG. 3 represents a partly fragmentary and enlarged schematic view, partly in section and diagrammatic, and illustrating the apparatus used in a roll support and dispenser, and a guide means used therewith providing a simple but novel operation by an attendant.

In FIGS. 3 and 4 there is diagrammatically shown the novel apparatus for carrying and positioning a roll of film as used in either the form station 34 or the seal station 36. The upper end or extent of this support is sufficiently rigid to support this roll of film which is drawn from this roll, thence to the idler roll arrangement of FIG. 1, then to forming and sealing. This illustration of roll support and adjustment anticipates rigid securement of a tubular member 90 to this upper end. The bottom portion of this tubular member 90 is made with a slot or cutout 92. This slot or cutout is made sufficiently wide for the protrusion of discs 93 and 94. As depicted, these discs provide guide means for a roll of film. As depicted, this roll is carried on a core 95 which is rotatable on the tubular member 90. As the film is often required to be replenished, this tubular member is not restricted to the right and an empty core 95 is removed and a new roll is mounted on this member 90.

As shown in FIG. 3, a clamp plate 96 is secured to the support to which the tubular member 90 is affixed. This clamp plate 96 is depicted as secured by cap screws 97*a* and, where desired, a compression of spring 97*b* may be utilized to provide a small hinge actuation for the upward movement of a threaded rod 98. Plate 96 may also be hinged, but it is desired that horizontal positioning be established by the face of clamp plate 96 against the left face of tubular member 90. This plate 96 is threaded to accept and retain the threaded portion of rod 98. This threaded rod may be sufficiently flexible to be bowed to lift disc 94 from in way of the core 95. A hollow and threaded knob-nut 100 has threads that mate with the threads on shaft 98. An adjusting knob 102 is secured to the end of this threaded shaft and when rotated causes this shaft 98 to be rotated. Disc 93 is threaded and is moved along the threaded shaft by rotation. A locknut 104 is shown adjacent disc 93 and is tightened to prevent unwanted movement of disc 93 along shaft 98. To the right disc 93 is disc 94 which is provided with a cam portion 106 which is adapted to be engaged by another locknut 104 which is like nut 104 described above. Farther to the right and at the distal end of shaft 98 is knob or protector 108. A bridge block or portion 110 is shown for providing an underguide surface for the core 95 of the film spool.

USE AND OPERATION OF ROLL SUPPORT OF FIGS. 3 AND 4

The roll support and width-adjusting apparatus in FIGS. 3 and 4 is particularly adapted for the form, fill and seal apparatus of this invention. The tubular support 90 is sized to accept and support a core of film or cover material. Although the core 95 diameter is approximately identical in the rolls to be used, the width of the roll material is determined by the package to be produced, including forming, filling and sealing. The clamp plate 96, whether hinged or using the bending capability of the rod 98, is so disposed or arranged that protective end 108 may be grasped and lifted upwardly to bring adjustable guide discs within the confines of the tubular member 90. This upward movement allows the empty core 95 to be slid rightly from the tubular support 90. For replacement of the empty core with a full roll, the full roll is placed on this tubular support and then slid to the left. The cam portion 106 is engaged by the inward movement of the core and is cammed upwardly sufficient to allow the full roll to be slid along the tubular support 90 and to the left until the core passes disc 94, after which the guiding discs drop downward with gravity to position and retain the new core and roll at and in the desired position. It is to be noted that lateral adjusting of the roll position before or during operation is easily achieved by loosening knob 100 from its lock condition and turning hand knob 102 to move the shaft 98 in the threaded plate 96.

As the roll and core are usually of the same width during a run for a predetermined packaging of a product, the only problem is for positioning of the bottom film 20 and the cover member 38. Adjusting of the space between the discs 93 and 94 is achieved after loosening nuts 104 and rotating the discs so as to provide a slide guideway for the core 95. This space is made sufficient for free rotation of the core and roll of material. The slot or cutout 92 is sufficient for access thereto by a suitable wrench means. These nuts 104 are loosened sufficiently for rotative movement of the discs 93 or 94 along the threaded shaft 98 to the desired position. After the desired space has been established, the locknuts 104 are again tightened. This arrangement permits an attendant to easily remove and replace the film or cover supply and to reposition the roll as desired. As far as is known, this method of adjustment and the simple but effective lift of the protruding portions of the discs for removal and the gravity drop for bringing the guide discs again in way of a new roll supply are novel.

In FIG. 4, the apparatus of the roll support is shown, and in this view tubular support 90 is shown as secured to the upper end of the support as by cap screws 112, with said tubular member 90 having the cutout 92 of sufficient extent or width for discs 93 and 94 to extend below this tubular member 90. The protective knob 108 is easily manipulated for upward movement for release of an empty core. When a new core and roll are to be mounted, the shaft and discs are dropped into operating position and the cam portions 106 provide cam surface means sufficient to provide displacing means for the replacing and positioning of the roll.

FILM ADVANCE OF APPARATUS OF FIGS. 5, 6 AND 7

Figure 9:
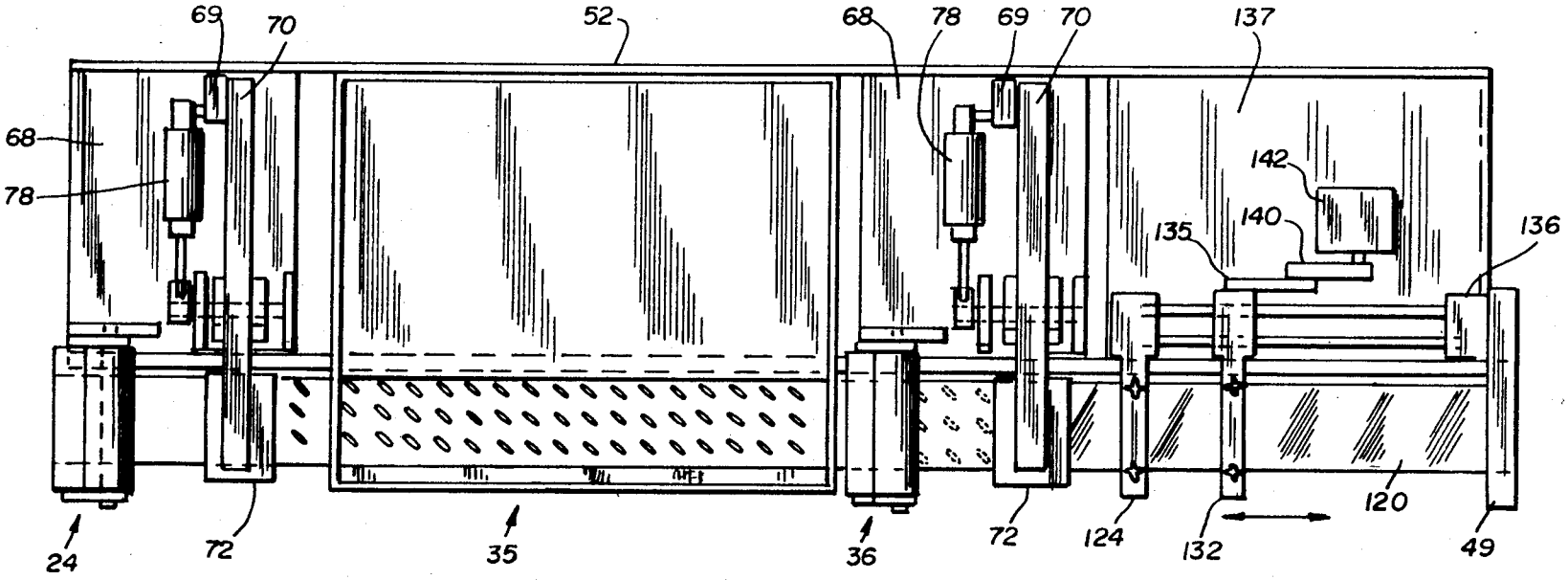
FIG. 9 represents a plan view of the apparatus as shown in FIG. 1, this view showing the relationship of the several components of this assembly.

The film advance is depicted in FIGS. 5, 6 and 7 and seen diagrammatically in FIG. 1. This film advance apparatus seals the cover to be secured in place. As the advance must be in timed response to the forming, filling and sealing, it is quite important that timing means be provided. In FIGS. 5, 6 and 7, a simple, adjustable positive means is provided. For the purpose of identification, the secured-together films are identified as 120. As seen in FIG. 5, these films have established side extents. A fixed clamp station includes near and far clamps 122 and 123. These clamps are secured to a support bar 124 secured to a head retainer 125 from which a pair of slide members 127 and 128 extend at right angles to bar 124. A pair of like clamps 130 and 131 are mounted on a movable support bar 132. This bar 132 is reciprocated back and forth with a slide block 134 which carries this bar and is moved by and with a pivotally-attached drag link 135. These slide members are retained at the distal or tail end by another retainer 136. These retainers 125 and 136 are secured to a support 137 (FIG. 9). Slide members 127 and 128 are carried in a spaced array to provide sliding clearance and movement of sliding block 134.

In FIGS. 5 and 6, the reciprocating actuating means is shown whereat the drag link 135 is pivotally attached to a Pitman or stroke arm 140. One end of arm 140 is secured to and turns with shaft 141 which is carried within the actuator mechanism 142. This arm is provided with a slot like a T-slot in a machine table so that an adjustable pivot pin may be moved in said slot. This slot is identified as 143 and the pivot pin and nut as 144. This adjustment of the effective length of arm 140 shortens or lengthens the movement of the film. This adjustment provides a selected and determined precise forward advance of the film and package. It is noted that a switch 146, as depicted, is actuated by the arm 140 as it reaches the forward extent of swing. Not shown but contemplated is an electric-eye device actuated by a precise spot on the cover.

FILM CLAMP ON FIG. 7

In the sectional and diagrammatic view of the clamping device of FIG. 7, an inexpensive but effective clamping device is illustrated, utilizing air pressure to actuate the clamp of the films. A lower support member 150 has a counterboard or stepped recess 152 in which the smaller diameter hole 153 is threaded to accept and retain the threaded end connector of an air hose 154. Within the larger diameter 152 of this recess is a U-cup 155 much like the cup provided in a hydraulic brake cylinder for an automobile. This cup is moved upwardly under the influence of pressurized air. A flat strip of spring steel 157 has its outer end bent into a right angle 158. This angle portion is smoothed or otherwise made so as to be a non-penetrating protector of the lower portion of the sealed package. An L-shaped anvil member 160 is provided with a short leg portion 161 which is sized to provide a small space or recess below an extending longer leg portion 162. A cap screw 163 is depicted as passing through hole 164 in the spring teel member 157 into threaded hole 165 formed in the support member 150. A screw knob 166 may be manipulated for adjustably securing this clamp to support bar 124 or to bar 132. This adjustment is needed or desired to grip only the edges of the package strip 120.

USE AND OPERATION OF APPARATUS SHOWN FIGS. 5, 6 AND 7

The desired film advancing mechanism needs to be versatile in that the width of the strip is made to suit the packaged product. The size of the cavity and package is also a matter of selection. The head retainer member 125 is secured in a fixed manner as is also the distal support 136. Slide members 127 and 128 are arrayed in a fixed position on a support means 137 (FIG. 9). The film strip 120, having a determined width, and the clamps 122 and 123 on the support bar 124 are positioned so that the edges of the strip 120 are positioned and clamped so that the edges thereof are in way of the upward angle portion 158 which, as shown, is a short distance in from the edge of the film. Anvil 160 has its upper leg portion 162 positioned to engage the upper surface of the package edge when the clamp is actuated. During film or package advance, these two clamp portions are in the non-gripping condition as seen in FIG. 7. Clamp portions 130 and 131, which have been positioned previously on movable support bar 134, are closed on the edge portions of the strip. The closing is easily and rapidly achieved by causing a supply of pressurized air to enter recess 152 and urge U-cup 154 upwardly and, correspondingly, the spring steel member 157 upwardly to effect a clamping action.

Advancement of the package strip 120 is performed in and with a timed sequence provided with and by an electronic control, not shown. Pressurized air is admitted to clamps 130 and 131 at the same time the rotary actuator 142 and shaft 141 are revolved counterclockwise through substantially one-half a revolution and until arm 140 actuates switch 146 to halt the advancing movement. At this time period at the stop of the advancement, pressurized air is cut off to clamps 130 and 131. The supply line is vented so that the spring steel member 157 moves downwardly sufficiently to release the edges of the strip. At this same time, pressurized air is fed to the cavity 152 and to the U-cup 155 of clamps 122 and 123 to clamp the strip 120 and prevent further movement. During this clamping of the strip by clamps 122 and 123, the rotary actuator 142 reverses to cause slide block 134 and the clamps 130 and 131, which are in open condition, to return to the start position. Adjustment of advancement is provided by the adjustment of the stroke length by utilizing the T-slot 143 provided in member 140.

CHART OF FIG. 8

Figure 8:
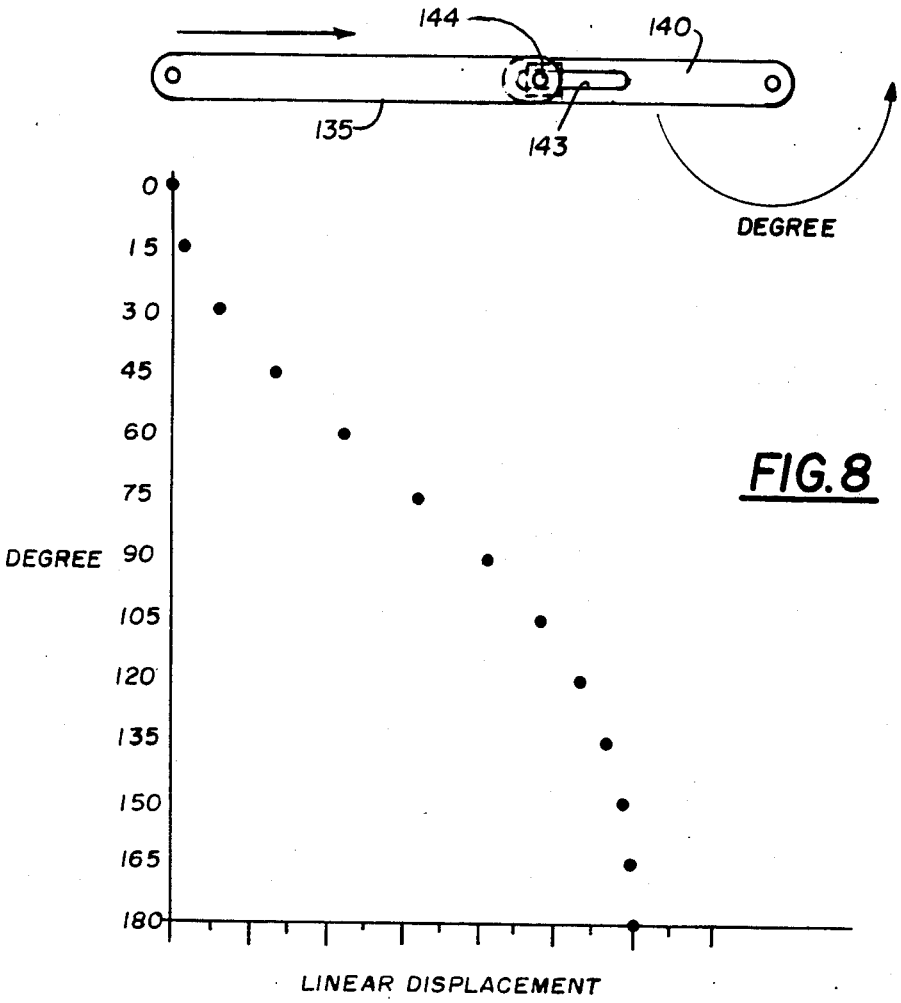
FIG. 8 represents a diagram of the film advancing motion as provided by the rotary actuator, with a connected drag link and stroke arm.

Referring next to FIG. 8, there is depicted a chart of the speed advance provided by the swing (one hundred eighty degrees or less) of the stroke crank arm 140. Drag link 135, as connected by the pivot post 144 to arm 140, is caused to move at a varying speed. As the initial start of this swing movement of arm 140 is sinusoidal, the maximum speed is at the low point of the swing. It is to be noted that when arm 135 approaches the forward position of arm 140, the advancement speed is rapidly reduced. This speed advancement of the film is very desirable. This motion allows the film to be started in its movement with a smooth acceleration rather than with a sudden jerk. The deceleration of the strip movement also brings the advancement of the film to a smooth stop. It is to be noted that the swinging idler arms and gravity-moved rollers 32 and 46 are utilized to insure that strips 20 and 37 are not unduly brought to a horizontal sag condition. Jerky advancement would develop this potential sagging, which is very undesirable. Identification of the several lines on the chart is by description rather than number identification.

EMBODIMENT SHOWN IN FIG. 9

In FIG. 9, a plan view of the assembled apparatus is like that as in FIG. 1 described above. The station 24 in which the bottom film is delivered to the heater and die station is as shown in FIG. 2, with the heater 72 identified. The filling station 35 is also identified, but it is to be noted that this filling station is adapted for filling those formed pockets of the lower film. The cover station 36 supplies a strip of material to another heater 72, after which the now-sealed product, now identified as strip 120, is advanced forwardly in a timed manner as in the chart of FIG. 8. This advancing mechanism is shown in FIGS. 5, 6 and 7. The actuator 142 is shown with the drag link 135 and the arm 140 positioned for use. Frame 52 is depicted as supporting the rear support member 68 which carries the cylinder 78, and the upper arm 70 is also shown. Plates 68, seen in more detail in FIG. 2, are also depicted and identified.

SECTIONAL SHOWING OF FIG. 10

Figure 10:
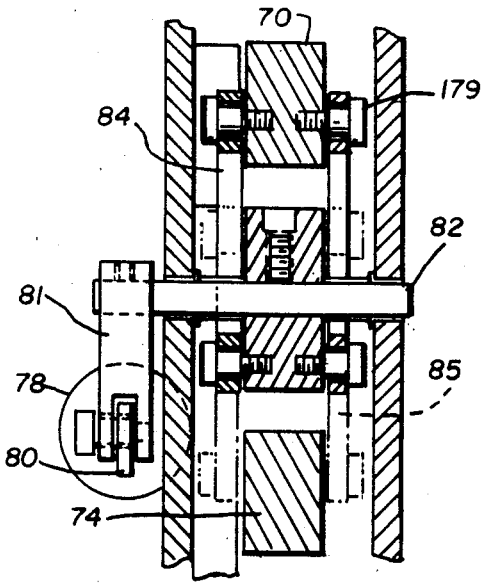
FIG. 10 represents an enlarged view, partly in section and diagrammatic, this view taken on the line 10—10 of FIG. 2 and looking in the direction of the arrows.

Referring next, and finally, to the drawings and FIG. 10 in particular, the preferred arrangement of the actuation produced by cylinder 78 is shown. This cylinder moves arm 80, which in turn reciprocates shaft 82. To provide a balance of forces, the arms 70 and 74 have links 84 and 85 arrayed in pairs, with a link on each side of an arm. For the purpose of identification, a pivotal connection is provided by bearing means and cap screws 179. The cylinder 78 moves the arm 81 in a ninety degree arc. As noted above, when the heater 72 and die 76 are brought to a closed condition, arms 84 and 85 are slightly over center to provide a lock condition.

USE AND OPERATION OF THE APPARATUS

The above-described apparatus is anticipated to be used with a film usually less than ten inches in width, and the thermoformed pocket is formed in the bottom film 20 at the forming station 34. The film advance shown in FIGS. 5 and 6 anticipates that intermittent motion of the film is provided. During the dwell period, when clamps 122 and 123 are in closed gripping condition, the forming station is actuated and the dies 72 and 76 are brought into a closed condition. As shown in FIG. 2, it is to be noted that in the open condition the film 20 is substantially intermediate the dies so that, if the run is interrupted, the film 20 is not unduly heat-softened or formed. When the dies are brought to a closed condition by cylinder 78, it is contemplated that a vacuum means (not shown) is drawn in the heater member 72 to draw film 20 toward and tightly against heater means in member 72. After a short period of time, the vacuum in the member 72 is terminated and vacuum means (not shown) is drawn in the forming die to pull the now heat-softened film into the forming cavity. After the forming operation is completed, the vacuum to the forming die is also terminated and the cylinder 78 is again actuated so that the film 20 is released and with the formed pockets is advanced.

Depending upon the product to be packaged, the loading area 35 may be one, two or more formed cavity lengths long. The extent of the loading area is a matter of selection. The film usually provided is rigid vinyl from three- to seven-thousandths of an inch in thickness and four to six inches in width. The swing arm 33 and the idler roller 32 are sufficient to cause a serpentine deflection to maintain the needed tautness in the film when inertia produces a slack or momentary overrun of the roll 21 resulting with the film 20 advance. The cover 37 may be film, paper or the like and may or may not be printed to indicate the contents. This strip is sufficiently treated or otherwise is adapted to be sealed to the film 20 when heat is supplied. The roll 36 is subject to overrun and slack when the package is advanced by the mechanism shown in FIGS. 5, 6 and 7. The bottom film 20, after forming, is contemplated to be sufficiently rigid or stiff so that the cover member 37 may be sealed to the lower film at the periphery of the cavity. Stiffness and rigidity are necessary so that an integral seal of the cover to the lower film may be made at all peripheral areas.

The packaged-and-sealed product is advanced to a cutoff knife means, identified as 180. This cutoff means is shown in FIG. 1 as upper and lower knife blades, but cutoff or severing mechanism is well known and no patentable distinction is ascribed thereto. As pressurized air is used in other operations of this apparatus, this cutoff may be also air-actuated. The cutoff station is contemplated as having an adjustable positioning means which enables the severing of the package to be at a precise, selected position.

Since the packaging of the product is a matter of size and design, the product package may have a plurality of side-by-side pockets and with a depth also a matter of selection. The forming station 34 and the sealing station 36 may be moved to a selected position along the frame 52 through loosening manipulation of the knobs 58 and the slot 56. This apparatus is contemplated to be operated by a single operator and the filling or load area 35 is contemplated to employ automatic and selected means. If medical supplies, such as pills and/or capsules, are to be packaged, conditions acceptable to government regulations and restrictions must be employed. Such conditions and restrictions are a matter of product integrity and are not a subject of this invention. The versatility of the above-described apparatus provides a novel one-man service for packaging in a form, fill and seal operation. Where a printed portion of the sealed-on cover is utilized as a register, the rotary actuator 142 is electronically controlled so the stroke crank 140 ceases advancement in response to such signal. When an electric eye is used, the crank stroke is made a little long so the advancement is sufficient to bring this indicator means in way of the electric eye. This signal causes the clamp actuation to cease and the pneumatic feed to the clamps to be reversed. The film ceases to be advanced and actuator 142 either reverses or may complete a revolution to bring slide block 134 and associated clamps 130 and 131 back to their start position.

The above-described apparatus suggest a novel method for providing a form, fill, seal and cutoff packaging of a product in a thermoplastic bottom film member and a cover member, said method adapted for intermittent motion operation and including the steps of:

providing a base supporting structure on which is adjustably mounted a forming station for thermoforming a substantially rigid bottom plastic strip member carried in roll and on a roll support with guiding means and slack controlling of said strip member during acceleration and deceleration, and positioning means to direct this strip into a substantially horizontal run in which forming of said thermoplastic is by a forming die member and a heater member, and carrying each member on a toggle-actuated arm so that the film strip is disposed intermediate these members so as to be in an unaffected condition until these members are brought together to provide a forming of said strip member;

placing a loading station downstream of the forming station and providing access to the open top of the formed cavity or cavities in this strip member;

adjustably positioning a seal station in way of and above the formed-and-filled bottom strip member and covering said strip member by a sealing member carried in strip form on a roll support and establishing guide means and slack-controlling of the cover strip member during acceleration and deceleration of this cover member, said cover member selected of a material adapted to be heat-sealed to a filled and thermoformed bottom member, including in this sealing station a heat member and a supporting member, with each member carried on a toggle-actuated arm, and disposing the lower film and cover intermediate these members so as to be in an unaffected condition until these members are brought together to make the seal;

providing a strip advance station including a multiplicity of edge clamps, with a first pair of clamps carried by a support and adjustably positioned to accommodate a width of the sealed strips, and a second pair of clamps carried by a support and slide block and reciprocably moving said slide block along slide rails by a rotary actuator by and with an actuated drag link and crank arm providing smooth acceleration and deceleration, with the clamps selectively actuated in reference to the position of the movable clamps and movable slide block, and severing the packaged product by and with a cutoff device in and at a selected position.

The above apparatus and method provide for attendant operation and adjustment permitting rapid change for the differing packaging of products without a change in basic apparatus. This adjustability and versatility provides many economies not previously available to a producer. The forming station is novel in that the roll support permits and is designed to particularly provide ready replacement of an empty roll core with a full roll. This replacement requires and upward lift of a hinged, threaded rod which carries two guide discs. These discs are spaced on the shaft to slideably retain the web of the roll in a desired guide position. Adjustment of the roll along the tubular support is easily achieved before, during and after operation of the apparatus. Three idler rollers are provided the form and the sealing stations. These idler rollers have an intermediate roller carried on a swing arm to provide a slack accommodation of the web as it is accelerated and decelerated.

The thermoplastic film strip is of a sufficiently thick film so that rigidity is present for applying a seal strip to the formed film strip. The heater member is carried on a pivotally-retained arm and the form die is carried on another arm. Where a sealing operation is to be performed, the lower member rather than a forming die is a supporting member. Whether a forming station or a sealing station, the arms are actuated by a pneumatic cylinder which moves a toggle link apparatus which, in the closed condition, provides a slightly over-center lock. It is to be noted that the strip line is essentially midway of these two members whether in the forming station or in the sealing station. This midway positioning is deliberate so as to provide for starting and stopping operations without altering the characteristics of the strip by proximity to a heater member. Conventionally, the seal strip is the same width as the bottom film, but is only required to cover the be sealed to the formed film pockets to provide a protective secured cover. The arrangement of the roll on the seal station is merely a matter of preference.

The film-advance section is specifically adapted to receive and advance the sealed strip. The clamps are each adapted to positively grip the edges of the lower film and cover material. These clamps are slideably positioned on a support bar and are actuated by valve means so that when advance is desired, the second pair of clamps on that member secured to the slide block is caused to close and grip the sealed package strip, while at this same time the first pair of clamps is in an open condition. After a desired advance of the strip, the second pair of clamps is opened and the first pair of clamps is closed to grip the strip. The construction of the clamp is inxpensive and very positive. The rotary actuator is stopped either by a stroke switch or an electric eye. The rotary actuator may move one hundred eighty degrees and reverse or rotate a full circle, as provided by the designer. The shown apparatus allows for adjustment of the stroke length of advance. It is to be noted that blocks 125 and 136 are secured to the base in a, more or less, permanent manner, but if desired may be carried on a plate that may be moved to a selected position. The strip cutoff or severing is contemplated to be adjustably positioned to suit the product. The seal cover may be paper or film or the like. This cover must be amenable to heat-sealing to retain integrity of the packaged product. Solvent-sealing is also contemplated, but is usually not provided because of cost and problems. Adjustability of positioning of the several stations is shown and simple knob control is indicated.

Terms such as "left," "right," "up," "down," "bottom," "top," "front," "back," "in," "out," "clockwise," "counterclockwise" and the like are applicable to the embodiment shown and described in conjunction with the drawings. These terms are merely for the purposes of description and do not necessarily apply to the position in which the apparatus for form, fill, seal and cutoff of a packaged product may be constructed or used.

While a particular embodiment of the apparatus and method of forming, filling, sealing and severing a packaged product have been shown and described, it is to be understood that the invention is not limited thereto and protection is sought to the broadest extent the prior art allows.

What is claimed is:

1. A method for providing a form, fill, seal and cutoff packaging of a product in a thermoplastic bottom member and a cover member, said method adapted for intermittent motion operation and including the steps of:

(a) providing a base supporting structure on which is adjustably mounted a forming station for thermoforming a substantially rigid bottom plastic strip member carried in roll and on a roll support with guiding means and slack-controlling of said strip member during acceleration and deceleration, and positioning means to direct this strip into a substantially horizontal run in which forming of said thermoplastic is by a forming die member and a heater member, and carrying each member on a toggle-actuated arm so that the strip member is disposed intermediate these members so as to be in an unaffected condition until these members are brought together to provide a forming of said strip member;

(b) placing a loading station downstream of the forming station and providing access to the open top of the formed cavity or cavities in this strip member;

(c) adjustably positioning a seal station in way of and above the formed-and-filled bottom strip member and covering said strip member by a sealing member carried in strip form on a roll support, and establishing guide means and slack-controlling of the cover strip member during acceleration and deceleration of this cover member, said cover member selected of a material adapted to be heat-sealed to a filled and thermoformed bottom member, including in this sealing station a heat member and a supporting member, with each member carried on a toggle-actuated arm, and disposing the lower strip member and cover intermediate these members so as to be in an unaffected condition until these members are brought together to make the seal;

(d) carrying the roll supply of thermoplastic bottom strip material on a core and the cover and roll supply of sealing strip material on another core, with each core slideable on a tubular support, each support having a retained end carried on and by a substantially vertical member, and forming in each tubular support a slot opening through which a pair of threaded disc guide plates selectively extends to provide side guide retainers for the core and roll of material thereon;

(e) carrying the threaded disc guide plates on a threaded rod and carrying one end of said threaded rod in a threaded portion of a support secured to said vertical member, and as said rod is rotated these disc guide plates are moved with said rod, each of said threaded disc guide plates adapted to rotation and positioning along said rod to provide a desired spacing therebetween, and with a nut carried on the threaded rod adjacent each disc guide plate so that when the nut is adjusted to a tightened condition against the side of a disc guide plate, said plate is retained, the rod movable from an apparatus running condition to a lift condition whereat these disc guide plates are moved from engagement with the core and the associated roll of strip may be removed and/or installed on the tubular support;

(f) providing a strip advance station including a multiplicity of edge clamps, with a first pair of clamps carried by a support and adjustably positioned to accommodate a width of the sealed strips, and a second pair of clamps carried by a support and slide block and reciprocably moving said slide block along slide rails by a rotary actuator by and with an actuated drag link and crank arm providing smooth acceleration and deceleration, with the clamps selectively actuated in reference to the position of the movable clamps and movable slide block, and (g) severing the packaged product by and with a cutoff device in and at a selected position.

2. A method for packaging a product as in claim 1 which includes the further step of providing the distal disc guide plate with a camming ramp portion which is engageable by a core of the roll and, with the roll pushed along the tubular support, the distal disc guide plate is caused to be displaced from in way of the core to allow the roll to be further positioned along the tubular support until the roll is brought to a desired positioning whereat the disc guide plates drop into a desired guide position.

3. A method for packaging a product as in claim 2 which further includes providing and mounting on the distal end of the threaded rod a protective member that not only provides protection but also manipulation for lifting the rod and disc guide plates from in way of an empty core, and at the other end of said threaded rod providing a threaded lock knob and also another knob fixed to the end of said rod to provide rotational turning of said rod to provide adjustment of the position of said guide discs.

4. A method for packaging a product as in claim 1 which includes the further step of providing the forming station with a pair of forms and pivotally attaching one end of each of the arms and actuating these arms with a toggle actuation by a pneumatic cylinder which moves the distally-attached heater and die-forming members to an open and closed condition by moving a lever arm portion to and from an over-center lock position, this lock position provided during heating and forming, and when in open condition the film is sufficiently intermediate the attached members to be unaffected by heat.

5. A method for packaging a product as in claim 4 which further includes carrying the forming station apparatus on a slide plate which is carried and supported on slide guide bars, and providing an adjustably tightened and loosened knob secured to a threaded shank that permits the forming station apparatus to be positioned at a desired location.

6. A method for packaging a product as in claim 3 which includes the further step of providing the distal disc guide plate with a camming ramp portion which is engageable by a core of the roll and, with the roll pushed along the tubular support, the distal disc guide plate is caused to be displaced from in way of the core to allow the roll to be further positioned along the tubular support until the roll is brought to a desired positioning whereat the disc guide plates drop into a desired guide position.

7. A method for packaging a product as in claim 1 which includes the further step of providing the sealing station with a pair of arms and pivotally attaching one end of each of the arms and actuating these arms with a toggle actuation by a pneumatic cylinder which moves the distally-attached heater and supporting members to an open and closed condition by moving a lever arm portion to and from an over-center lock position, this lock position provided during heating and sealing, and when in open condition the strip is sufficiently intermediate the attached members to be unaffected by heat.

8. A method for packaging a product as in claim 1 which includes the further step of providing in the strip-advancing station a pair of fixed support blocks and fixedly securing therebetween a plurality of slide rails, and on the first support block carrying a support bar and adjustably carrying on said bar a first pair of clamps, each clamp adapted to selectively engage and grip an edge of a packaging strip, and further slideably carrying on said slide rails a reciprocably moved slide block which carries a support bar and carrying on said bar a second pair of adjustably-positioned clamps, each adapted to be selectively positioned and engage an edge of the strip, the first and second pairs of clamps actuated by pressurized air and with valve means and a timing sequence so that when the first pair of clamps is actuated to a gripping condition, the second pair of clamps is disengaged and vice versa, and acuating the second pair of clamps to a gripping condition only during strip advancement.

9. A method for packaging a product as in claim 8 which further includes the step of pivotally securing one end of the drag link to a T-nut carried in a slot in a crank arm and pivotally connecting the other end of said drag link to the slide block, the T-nut and slot permitting adjustable securing of the drag link to the crank arm to make the advancing stroke a desired selected length and with the other end of the crank arm secured to a shaft of the rotary actuator.

10. A method for packaging a product as in claim 9 which includes providing, adjustably positioning and securing a stop switch which is actuated by and with the forward movement of the crank arm causing a halt to advancement to the strip.

11. Apparatus for providing a form, fill, seal and cutoff packaging of a product in a thermoplastic bottom member and a cover member, said apparatus adapted for a table-top arrangement and intermittent motion operation and including:

(a) a base supporting structure;

(b) a forming station for thermoforming a substantially rigid bottom plastic strip member carried in roll and on a roll support with guide means and a slack-control of said strip member during acceleration and deceleration, and with means to direct this strip into a substantially horizontal run in which forming is provided by a forming die member and a heater member, each member carried on a toggle-actuated arm, with the film strip disposed intermediate these members so as to be in an unaffected condition until these members are brought together to provide a forming of said strip member;

(c) a loading station downstream of the forming station and providing access to the open top of the formed cavity or cavities in this strip member;

(d) a seal station for covering the formed-and-filled bottom strip member, with a cover member carried in strip form on a roll support with guide means and slack control of the cover strip member during acceleration and deceleration of this cover member and with said cover member adapted to be heated-sealed to thermoformed bottom member, this sealing station including a heater member and a supporting member, with each member carried on a toggle-actuated arm, with the bottom plastic strip and cover member disposed intermediate these members so as to be in an unaffected condition until these members are brought together to make the seal;

(e) a substantially vertical member for each roll supply of film, with each member carried by the base supporting structure, each film carried on a core that is slideable and rotatable on an upper support-surface portion of a tubular support member having a regular inner and outer diameter, each tubular support member carried on and by said substantially vertical member, each tubular support member having a slot opening substantially opposite the roll upper support-surface portion thereof;

(f) a pair of threaded disc guide plates carried within each tubular support member, each guide plate sized to be freely rotatable within the inner diameter of the tubular support member and adjustably movable in the tubular member for removal of the core and replacement with a roll of film;

(g) a threaded rod on which a pair of disc-like guide plates is carried, this rod carried by a support having a compatibly threaded portion adapted to carry the threaded rod and to move with said rod as the rod is rotated, said threaded disc-like guide plates moved along the threaded rod by rotation, and with each of these disc guide plates after desired positioning being locked in position by a threaded nut carried on the threaded rod and to be turned to lock the disc guide plates in the desired position, and when the rod is moved upwards the disc guide plates are lifted from engagement of the core, the disc guide plates when the apparatus is in running condition have the threaded rod positioned so that the guide plates extend below the tubular support member so as to slideably engage and guide the associated roll of plastic;

(h) a strip advance station which includes edge clamping means, with a first pair of clamps carried by a support and adjustably positioned to accommodate the width of a sealed strip, and another second pair of clamps carried by a support and slide block that is reciprocably moved along slide rails by a rotary actuator, with an actuated drag link and crank arm providing smooth acceleration and deceleration, with the clamps selectively actuated in reference to the position of the movable clamps and movable slide block, and (i) cutoff means for severing the packaged product in and at a selected position.

12. Apparatus for packaging a product as in claim 11 which further includes providing an end member on the distal end of the threaded rod so as to provide protective means and a manipulative means for lifting the rod and disc guide plates from in way of an empty core, and at the other end of said threaded rod providing a threaded lock knob and also another knob fixed to the end of said rod to provide rotational turning of said rod to provide adjustment of the position of said disc guide plates.

13. Apparatus for packaging a product as in claim 12 which further includes three idler rollers carried in the path of the thermoplastic strip as said strip is fed from the roll to said forming station, said idler rollers having the first and third rollers freely turning on bearing means on fixed axles, with said first and third idler rollers arranged to engage the upward surface of the strip and a second idler roller carried on a pivotally-swung arm, with said second idler roller weighted and also freely turning and disposed to swing into engagement with the underside surface of the strip of cover material, these three idler rollers providing the slack control for the advancing strip of cover material.

14. Apparatus for packaging a product as in claim 13 in which the toggle-actuated arm carrying the heater member and bottom supporting member is actuated to an open and closed condition by a pneumatic cylinder which moves a lever arm portion to an overcenter lock during heating and sealing.

15. Apparatus for packaging a product as in claim 14 in which the sealing station, which includes the roll support, idler rollers and actuating apparatus and associated toggle mechanism for the heater member and support member, is carried on a slide plate carried and supported on slide guide bars, with this station adjustably positioned and secured by loosening and tightening a clamp knob.

16. Apparatus for packaging a product as in claim 11 in which the cutoff means is a pneumatically-actuated knife apparatus, said apparatus adjustable as to position so that the resulting severing is precisely made to suit the customer's requirement.

17. Apparatus for packaging a product as in claim 11 in which the strip advance station further includes a fixed support block which carries the support for the first pair of clamps and one end of the slide rails, with the other ends of the slide rails carried and secured in and by another fixed support block, said slide block as reciprocably moved on said rails also carrying a support member on which is adjustably positioned the second pair of clamps, with the first and second pairs of clamps actuated by pressurized air and with valve means and a timing sequence so that when the first pair of clamps is actuated to a gripping condition, the second pair of clamps is disengaged and vice versa, and with the second pair of clamps actuated to a gripping condition only during strip advancement.

18. Apparatus for packaging a product as in claim 17 in which the drag link is pivotally secured at one end to the slide block and at its other end of said link to a T-nut and a rotary means so that said connection permits rotation, and with the crank arm having a slot therein permitting adjustable securing of the drag link to the crank arm to make the advancing stroke a desired selected length and with the other end of the crank arm secured to a shaft of the rotary actuator.

19. Apparatus for packaging a product as in claim 18 in which a stop switch is positioned and secured so as to be actuated by the crank arm when the desired advance is achieved.

20. Apparatus for packaging a product as in claim 19 in which each clamp includes a base block adjustably carried by and secured to a support, said base block having a stepped bore and in the larger diameter bore is disposed a resilient U-cup adapted to be moved by pressurized air, and with said cup adapted to move an L-shaped spring steel leaf jaw whose short leg is adapted to engage one surface of the strip, and with an opposed upper mandrel having an L-shape, with the shorter leg providing a space support and the longer leg portion an upper jaw portion between which the strip moves and is engaged for a clamping actuation.

21. Apparatus for packaging a product as in claim 11 which further includes providing the distal disc guide plate with a camming ramp portion engageable by a core of roll and, with the roll pushed along the tubular support, the distal disc guide plate is caused to be displaced from in way of the core to allow the roll to be further positioned along the tubular support until the roll is brought to a desired positioning whereat the disc guide plates drop into a desired roll guide position.

22. Apparatus for packaging a product as in claim 21 which further includes providing an end member on the distal end of the threaded rod so as to provide protective means and a manipulative means for lifting the rod and disc guide plates from in way of an empty core, and at the other end of said threaded rod providing a threaded lock knob and also another knob fixed to the end of said rod to provide rotational turning of said rod to provide adjustment of the position of said disc guide plates.

23. Apparatus for packaging a product as in claim 22 which further includes three idler rollers carried in the path of the thermoplastic strip as said strip is fed from the roll to said forming station, said idler rollers having the first and third rollers freely turning on bearing means on fixed axles, with said first and third idler rollers arranged to engage the upward surface of the strip and a second idler roller carried on a pivotally-swung arm, with this second idler roller weighted and also freely turning and disposed to swing into engagement with the underside surface of the strip of film, these three idler rollers providing the slack control for the advancing strip of film.

24. Apparatus for packaging a product as in claim 23 in which the toggle-actuated arms carrying the heater member and the forming die members are actuated to an open and closed condition by a pneumatic cylinder which moves a lever arm portion to an overcenter lock during closing for heating and forming.

25. Apparatus for packaging a product as in claim 24 in which the forming station, which includes the roll support, the idler rollers and the actuating apparatus, and the toggle mechanism for the heating and forming members are carried on a slide plate carried and supported on slide guide bars, with this station adjustably positioned and secured by loosening and tightening a clamp knob.

* * * * *